US008276921B2

(12) United States Patent
Walker

(10) Patent No.: US 8,276,921 B2
(45) Date of Patent: Oct. 2, 2012

(54) SNOWBOARD BINDING

(75) Inventor: Brendan Walker, New York, NY (US)

(73) Assignee: Brendan Walker, New York, NY (US)

( * ) Notice: Subject to any disclaimer, the term of this patent is extended or adjusted under 35 U.S.C. 154(b) by 311 days.

(21) Appl. No.: 12/554,713

(22) Filed: Sep. 4, 2009

(65) Prior Publication Data

US 2011/0057420 A1 Mar. 10, 2011

(51) Int. Cl.
*A63C 9/00* (2006.01)

(52) U.S. Cl. ..... 280/14.24; 280/612; 280/618

(58) Field of Classification Search ..... 280/607, 280/11.14, 11.15, 11.3–11.36
See application file for complete search history.

(56) References Cited

U.S. PATENT DOCUMENTS

| | | | | | |
|---|---|---|---|---|---|
| 3,353,835 | A | * | 11/1967 | Sommer | 280/612 |
| 3,667,771 | A | * | 6/1972 | Lawson | 280/612 |
| 3,927,897 | A | * | 12/1975 | Olson et al. | 280/612 |
| 4,196,920 | A | * | 4/1980 | Salomon | 280/613 |
| 4,652,007 | A | * | 3/1987 | Dennis | 280/618 |
| 4,741,550 | A | * | 5/1988 | Dennis | 280/618 |
| RE33,544 | E | * | 2/1991 | Dennis | 280/618 |
| 5,028,068 | A | * | 7/1991 | Donovan | 280/618 |
| 5,035,443 | A | | 7/1991 | Kincheloe | |
| 5,261,689 | A | | 11/1993 | Carpenter | |
| 5,354,088 | A | * | 10/1994 | Vetter et al. | 280/618 |
| 5,362,087 | A | * | 11/1994 | Agid | 280/611 |
| 5,499,837 | A | * | 3/1996 | Hale et al. | 280/607 |
| 5,505,478 | A | * | 4/1996 | Napoliello | 280/618 |
| 5,553,883 | A | * | 9/1996 | Erb | 280/607 |
| 5,695,210 | A | | 12/1997 | Goss et al. | |
| 5,743,550 | A | * | 4/1998 | Frohwein | 280/612 |
| 5,762,358 | A | | 6/1998 | Hale | |
| 5,913,530 | A | * | 6/1999 | Berger et al. | 280/607 |
| 5,941,552 | A | * | 8/1999 | Beran | 280/607 |
| 5,954,357 | A | * | 9/1999 | Golling | 280/612 |

(Continued)

FOREIGN PATENT DOCUMENTS

EP 1709999 A1 10/2006

(Continued)

OTHER PUBLICATIONS

International Search Report PCT/US10/47134 dated Oct. 26, 2010 with Written Opinion, 4 pages.

(Continued)

*Primary Examiner* — J. Allen Shriver, II
*Assistant Examiner* — Jacob Meyer
(74) *Attorney, Agent, or Firm* — Holland & Knight, LLP; Brian J. Colandreo, Esq.; Michael T. Abramson, Esq.

(57) ABSTRACT

A snowboard binding comprises two assemblies that are capable of being mated or docked with each other and locked together while the snowboard is in use. One of the assemblies may be affixed to the deck of the snowboard. In an embodiment of the invention, the other assembly may be secured, e.g., to the user's boot, and in an embodiment of the invention, the features of the other assembly that support docking and locking of the assemblies may be incorporated into a boot. Either or both assemblies may comprise one or more permanent magnets configured to assist docking by attracting the assemblies to one another in a manner that encourages them to dock in a proper configuration. In embodiments of the invention, locking the docked assemblies together may be achieved without use of the hands.

20 Claims, 18 Drawing Sheets

U.S. PATENT DOCUMENTS

| | | | | |
|---|---|---|---|---|
| 5,967,542 | A | 10/1999 | Williams et al. | |
| 6,022,040 | A * | 2/2000 | Buzbee | 280/613 |
| 6,135,486 | A | 10/2000 | Neiley | |
| 6,189,899 | B1 | 2/2001 | Carlson | |
| 6,189,913 | B1 | 2/2001 | Morrow et al. | |
| 6,206,403 | B1 | 3/2001 | Black et al. | |
| 6,224,086 | B1 * | 5/2001 | Golling | 280/612 |
| 6,227,552 | B1 | 5/2001 | Keller et al. | |
| 6,290,243 | B1 * | 9/2001 | Beran | 280/14.24 |
| 6,299,192 | B1 * | 10/2001 | Bryce | 280/613 |
| 6,315,305 | B1 | 11/2001 | Gien | |
| 6,557,866 | B2 * | 5/2003 | Jones et al. | 280/14.22 |
| 6,575,489 | B1 * | 6/2003 | White | 280/613 |
| 6,616,151 | B1 * | 9/2003 | Golling | 280/14.21 |
| 6,705,633 | B2 * | 3/2004 | Poscich | 280/618 |
| 6,722,688 | B2 * | 4/2004 | Poscich | 280/618 |
| 6,726,238 | B2 * | 4/2004 | Poscich | 280/624 |
| 6,983,952 | B2 * | 1/2006 | Golling | 280/612 |
| 7,059,614 | B2 * | 6/2006 | Cole, III | 280/14.24 |
| 7,220,158 | B1 * | 5/2007 | Norris | 441/74 |
| 7,267,357 | B2 * | 9/2007 | Miller et al. | 280/617 |
| 7,270,337 | B1 * | 9/2007 | Carotenuto | 280/14.24 |
| 7,281,717 | B2 * | 10/2007 | Sacco et al. | 280/14.22 |
| 7,296,805 | B2 * | 11/2007 | Lindemann | 280/14.22 |
| 7,338,067 | B2 * | 3/2008 | Flaig | 280/611 |
| 7,416,191 | B2 * | 8/2008 | Yoshino | 280/14.22 |
| 7,658,398 | B2 * | 2/2010 | Panzeri | 280/618 |
| 7,823,300 | B2 * | 11/2010 | Fullerton et al. | 36/113 |
| 8,065,819 | B2 * | 11/2011 | Kaufman | 36/50.1 |
| 2003/0047910 | A1 * | 3/2003 | Golling | 280/612 |
| 2003/0075890 | A1 * | 4/2003 | Jacobs | 280/87.042 |
| 2003/0094788 | A1 * | 5/2003 | Jacobs | 280/612 |
| 2003/0164599 | A1 * | 9/2003 | Golling | 280/14.21 |
| 2003/0164605 | A1 | 9/2003 | Maravetz et al. | |
| 2007/0090627 | A1 * | 4/2007 | Laurent | 280/612 |
| 2010/0253021 | A1 * | 10/2010 | Kostantin | 280/11.33 |

FOREIGN PATENT DOCUMENTS

| | | | |
|---|---|---|---|
| FR | 2851173 | A1 | 8/2004 |
| JP | 10314365 | A | 12/1998 |
| WO | 2005092454 | A1 | 10/2005 |

OTHER PUBLICATIONS

English abstract of French abstract for FR 2851173, 1pg.
English abstract of Japanese abstract for JP 10/314365, 1 pg.
Supplementary European Search Report EP 10 81 3095, dated Jan. 4, 2012 with written opinion (7 pages).
International Preliminary Report on Patentability received in PCT/US2010/047134 mailed Mar. 15, 2012, 9pgs.
International Search Report and Written Opinion of the International Searching Authority received in PCT/US2012/022976 mailed May 10, 2012, 8 pgs.

* cited by examiner

SNOWBOARD BINDING

BACKGROUND

When riding a snowboard, each of the user's boots is secured to the snowboard, e.g., with an apparatus called a "binding." The bindings keep the user and board from separating during the ride down the slope. Bindings are also commonly configured to transfer forces from the user to the snowboard, allowing the user to control the snowboard during the ride.

One common type of binding for use with a snowboard, which may be referred to as a "strap-in" binding, may be designed to receive a boot, such as, for example, the type of boot that may be referred to in the art as a "soft boot." A strap-in binding commonly incorporates one or more adjustable straps, which, when tightened, push the user's boot against the relatively rigid interior surfaces of the binding. The pressure of the straps and the interior surfaces hold the boot in the binding while the snowboard is in use and help the user to control the snowboard.

Another common type of snowboard binding may be referred to in the art as a "step-in" binding. A step-in binding may incorporate a relatively flat base that includes a mechanism that connects to hinges, fixtures, and/or other mechanisms on the bottom of the user's boot. A boot for use with a step-in binding is typically more rigid and sturdy than one typically used with a strap-in binding, and the rigid structures of the boot may transmit forces exerted by the user to the board, helping the user to control it. The construction that makes a boot suitable for use with a step-in binding may also make the boot heavier than a soft boot, however, as may the hardware built into the boot that is needed to secure the boot to the snowboard.

Inconveniences attend use of either of the strap-in binding and the step-in binding. For example, securing a boot inside a strap-in binding commonly requires that the user's hands be available to tighten the straps. A common consequence is that a snowboard user cannot ride directly off of a ski lift and onto a slope, as skiers may do, because the user typically must first get off of the ski lift and then secure at least one boot to the appropriate binding.

Step-in bindings, as mentioned above, commonly entail using boots that may be heavier and stiffer than the soft boots that may typically be used with a strap-in binding. The weight and rigidity may make such boots less comfortable to wear than soft boots, and experienced snowboard users may feel that the weight and rigidity compromise the user's control of the snowboard during a ride.

BRIEF SUMMARY OF THE INVENTION

Embodiments of the invention comprise a snowboard binding that comprises two main cooperating parts or assemblies. One part, which may be referred to as a "board base," may be secured permanently to the snowboard. The other part, which may be referred to as a "binding base" may be secured to a user's soft boot, e.g., in a manner similar to that of a strap-in binding. In an embodiment of the invention, the board base and the binding base may be detached from one another and may also be securely reattached to each other so that the user can ride the snowboard.

The binding base and the board base may be configured to help a user to join the bases without use of the hands. For example, in an embodiment of the invention, the user may wear a soft boot secured in a binding base and may, by moving the leg and/or foot, align the binding base with the board base, allowing the bases to be docked together. In an embodiment of the invention, the user may then, by rotating the foot, cause the bases to engage with each other to prevent the bases from separating. Continuing to rotate the foot may, in an embodiment of the invention, cause a locking mechanism to engage, keeping the bases joined in a configuration suitable for use. The locking mechanism may in an embodiment of the invention keep the bases in this configuration until manually disengaged.

Thus, according to an embodiment of the invention, a snowboard binding is provided that comprises a binding base configured to accept a boot while the boot is being worn by a user and comprising one or more adjustable straps located to secure the boot in the binding base. In the embodiment, the binding base is capable of being secured to a snowboard while the boot, being worn by the user, is secured in the binding base, and the binding base is capable of being separated from the snowboard while the boot, being worn by the user, is secured in the binding base.

According to an embodiment of the invention, a snowboard binding apparatus comprises a binding base that is configured to accept a boot while the boot is being worn by a user and comprises one or more adjustable straps located to secure the boot in the binding base. The snowboard binding apparatus also comprises a board base that is permanently affixed to a snowboard deck and capable of being locked to the binding base and released from the binding base.

In an embodiment of the invention, the binding base and the board base are configured to be docked with one another prior to being locked together. In one such embodiment of the invention, the binding base comprises one or more magnets, the board base comprises one or more magnets, and the magnets in the binding base and the magnets in the board base are configured to attract the binding base and the board base to one another in a docked configuration. Further, in an embodiment of the invention, when the board base and the binding base are in a docked configuration, rotating the binding base around an axis perpendicular to the snowboard deck mechanically engages the binding base and the board base. In an embodiment of the invention, further rotating the binding base around the axis engages a locking mechanism that prevents reversing the rotation, thereby securing the binding base and the board base in an engaged and aligned position for use.

In an embodiment of the invention, the board base comprises one or more shelves, the binding base comprises one or more lips, and the shelves and the lips are located in relation to one another so as not to interfere with docking the binding base to the board base, but also so that rotating the binding base around an axis perpendicular to the snowboard deck causes the shelves to overlap the lips in a configuration that prevents separation of the binding base from the board base. In one such embodiment of the invention, further rotating the binding base around the axis engages a locking mechanism that prevents reversing the rotation, thereby securing the binding base and the board base in an engaged and aligned position for use.

DETAILED DESCRIPTION OF PREFERRED EMBODIMENTS

Figure 1:
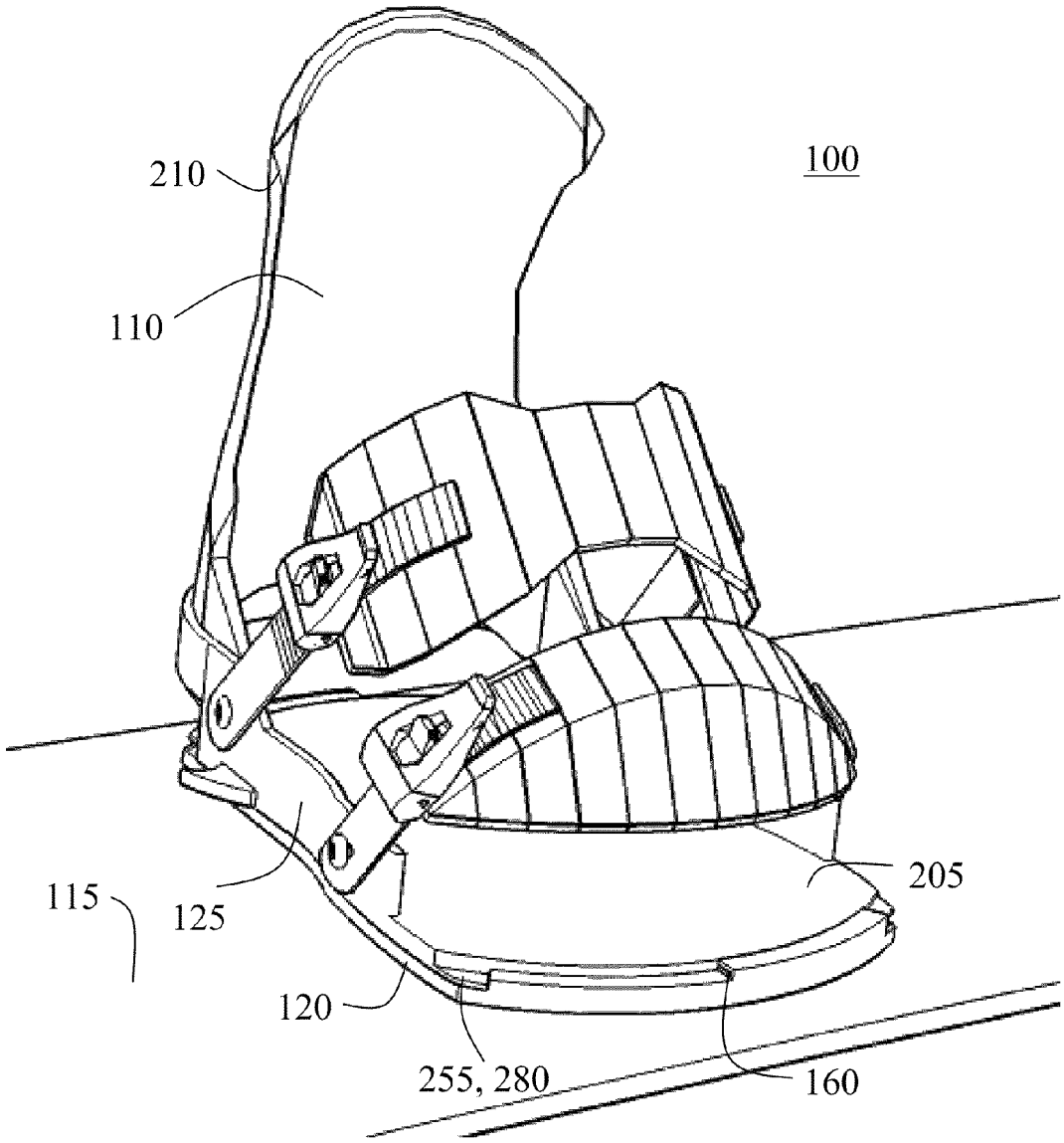
FIG. 1 depicts a binding affixed to a snowboard deck according to an embodiment of the invention.

FIG. 1 depicts an assembly 100 that comprises a snowboard binding 110 affixed to a snowboard deck 115 according to an embodiment of the invention. As depicted, the two principal cooperating components comprise a board base 120, mounted atop the snowboard deck 115, and a binding base 125. The board base 120 and the binding base 125 are depicted in a locked configuration, such as for use, according to an embodiment of the invention.

"Use" of a snowboard herein is meant in ordinary senses of the word. Just as in ordinary use of the term, depending on the context, a snowboard may be considered to be in use while the user is riding it down a slope, or while the user is secured to it, e.g., by one or more bindings according to an embodiment of the invention, or during a snowboarding session, which may comprise one or more rides down one or more slopes. The sense in which any particular instance of the term is meant herein may be determined from the context.

Figure 2:
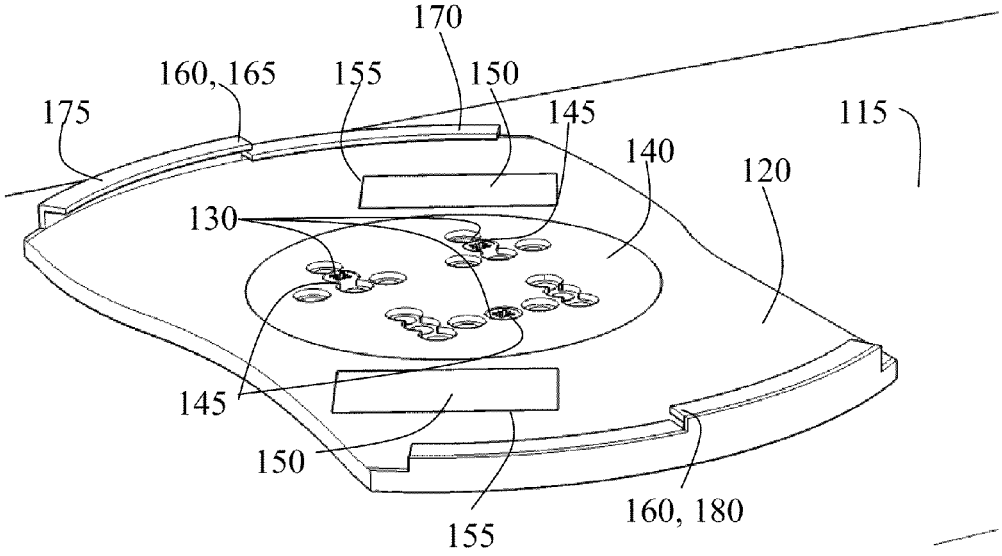
FIG. 2 depicts a board base, viewed from the heel side and affixed to a snowboard according to an embodiment of the invention.

FIG. 2 depicts a board base 120, according to an embodiment of the invention, which may be permanently held to the top of a snowboard deck 115. ("Permanent" is used here in a broad, contextual sense, to refer to a feature or configuration that is not normally altered during ordinary use of an embodiment of the invention. Depending on the embodiment of the invention, a feature or configuration referred to herein as permanent may or may not be alterable without causing damage to the assembly 100 or any one or more parts of it, and, if alterable, making such alteration may or may not involve appropriate tools.)

Methods of securing the board base 120 to the snowboard deck 115 include methods that are well known in the art. For example, a snowboard deck 115 may be manufactured to incorporate threaded metal inserts (not pictured). A board base 120 in an embodiment of the invention may be fastened, e.g., directly to the snowboard deck 115 by one or more fasteners 130 such as, for example, threaded bolts, screws, or studs, that pass, e.g., through one or more holes in the board base 120 into the threaded inserts in the base.

Figure 3:
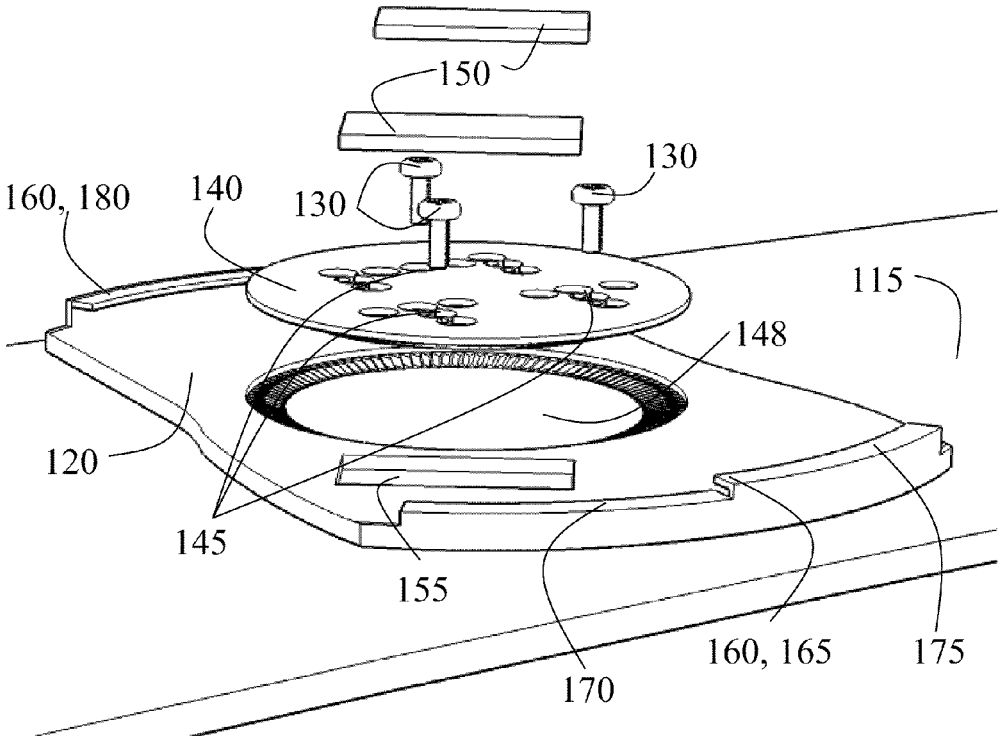
FIG. 3 is an exploded view of board base, viewed from the toe side, and a snowboard deck according to an embodiment of the invention.

In an embodiment of the invention such as FIG. 2 and FIG. 3 depict, the board base 120 is not directly affixed to the snowboard deck 115, but is held firmly against the deck 115 and prevented from rotating by an adjusting disk 140, e.g., as is known in the art. The adjusting disk 140 is in turn removably affixed to the deck 115 by threaded fasteners 130 that pass through respective holes 145 in the adjusting disk 140.

Figure 4:
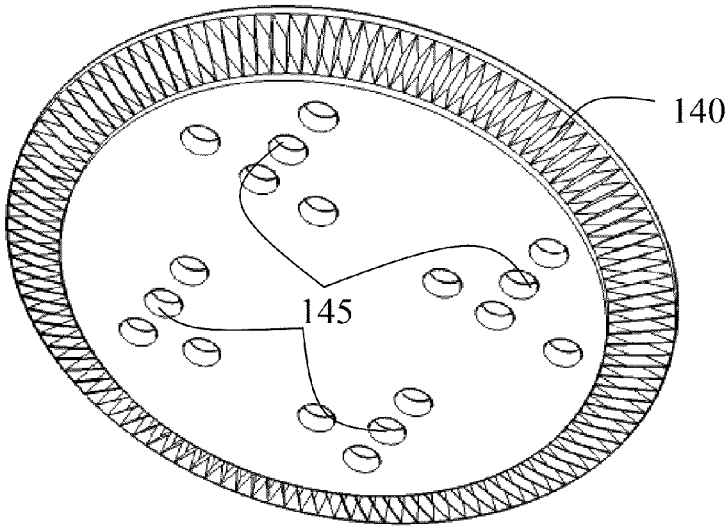
FIG. 4 depicts the underside of an adjusting disk according to an embodiment of the invention.

FIG. 3 provides an exploded view of the components depicted in FIG. 2. In an embodiment of the invention, the board base 120 includes a circular hole or cutout 148. In an embodiment of the invention such as FIGS. 2 and 3 depict, the rim of the underside of the adjusting disk 140 and the rim of the hole 148 comprise corresponding evenly-spaced ridges or other shapes. FIG. 4 depicts the underside of an adjusting disk 140, according to an embodiment of the invention, illustrating the ridges that may interlock with corresponding ridges in the snowboard base 120.

Returning to FIGS. 2 and 3, tightening the fasteners 130, in an embodiment of the invention, causes the adjusting disk 140 to press the board base 120 against the snowboard deck 115. In an embodiment of the invention, the alignment of the board base 120 relative to the snowboard deck 115 may be set, e.g., when the board base 120 is secured to the snowboard deck 115. The pressure exerted by the adjusting disk may hold the board base 120 firmly and securely to the snowboard deck 115, and the interlocking ridges in the adjusting disk 140 and the board base 120 may inhibit rotation of the board base 120 relative to the snowboard deck 115. If desired, in an embodiment of the invention, the alignment of the board base 120 relative to the snowboard deck 115 may be adjusted by loosening the fasteners 130, rotating the board base 120 into a desired alignment, and then tightening the fasteners 130.

In an embodiment of the invention, the dimensions of the board base 120 and the adjusting disk 140 may be such that, e.g., when the fasteners 130 are fully tightened, the bottom of the adjusting disk 140 is flush with the bottom of the board base 120. Similarly, the top of the adjusting disk 140 may be flush with the top of the board base 120. Further, in an embodiment of the invention, some or all of the holes 145 in the adjusting disk 140 may be, e.g., countersunk or counterbored at the top, causing the tops of some or all of the fasteners 130 to be flush with the top of the adjusting disk 140 or below it when the fasteners are fully tightened.

The board base 120 in an embodiment of the invention may comprise one or more permanent magnets 150. For example, in the embodiment of the invention depicted in FIGS. 2 and 3, the board base may comprise two cutouts 155, each with a flanged rim that is sufficient in extent and strength to retain one of the magnets 150 in the respective cutout 155 despite attraction between the magnet and any outside objects. In an embodiment of the invention, one or more of the magnets 150 may be, e.g., partially covered by, or encased in, a material such as nickel or plastic to protect and/or to improve the durability of the magnet 150.

Instead of or in addition to the foregoing, in an embodiment of the invention, one or more of the magnets 150 may be glued or otherwise fixed to the body of the board base 120. In an embodiment of the invention, one or more of the permanent magnets 150 (not pictured) may be embedded in the material of the board base 120. Instead of or in addition to fixing one or more of the magnets 150 to the board base 120, in an embodiment of the invention, one or more of the magnets 150 may be fixed to the snowboard deck 115 in a manner capable of exerting suitable attractive and/or repulsive forces on an object above but relatively near to the board base 120.

It will also be appreciated by one skilled in the relevant arts that other suitable ways exist to incorporate one or more magnets in the board base 120, in addition to or instead of one or more of the foregoing, in embodiments of the invention. In an embodiment of the invention such as FIGS. 2 and 3 depict, no portion of either magnet 150 protrudes from the upper surface of the board base 120.

In an embodiment of the invention, the board base 120 may comprise two separate sets of shelves 160, which project perpendicularly away from the snowboard deck 115. In an embodiment of the invention, each shelf 160 may describe, e.g., a portion of an hypothetical circle such that all shelves 160 describe respective portions of the same hypothetical circle.

One set of shelves 160 (the "toe side shelves" 165) may be, e.g., on the edge of the board base 120 nearest the user's toes. In an embodiment of the invention, the toe side shelves 165 may comprise, e.g., two shelves. In such an embodiment, one of the toe side shelves 170 may be, e.g., 1/16 of an inch from the surface of the board base 120, and the other 175 may be, e.g., 3/16 of an inch from the surface of the board base 120. The same or similar dimensions may be used, e.g., for the two depicted heel-side shelves 180.

The width of the shelves 160 may vary depending, e.g., on the strength and flexibility of the material or materials used and the manner of construction; for example, in the depicted embodiment of the invention, the shelves 160 are ¼ inch wide. In the depicted embodiment of the invention, all shelves 160 are the same thickness and width, but, in an embodiment of the invention, one or more of the shelves 160 may differ in thickness, width, or both from one or more other shelves 160.

Some or all of the shelves 160 may in an embodiment of the invention, such as FIGS. 2 and 3 depict, be made, e.g., as integral parts of the board base 120 or as distinct parts, that may be affixed directly or indirectly to the board base 120, e.g., during manufacture.

Returning to FIG. 1, a snowboard binding 110 according to an embodiment of the invention may comprise a binding base 125. The binding base 125 is, in an embodiment of the invention, configured to receive and retain a boot (not pictured), which may be worn by the user while the snowboard is in use. For example, a binding base 125 may in an embodiment of the invention be configured, e.g., in a manner similar to that of a strap-in binding, such as described above, to receive a soft boot (not depicted) and to secure it in place with one or more adjustable straps that are capable of holding the boot against the base 205 of the binding base 125 and a highback 210.

As described in more detail below, the binding base 125 is in the depicted embodiment of the invention configured to dock with the board base 120, e.g., guided and/or otherwise assisted by magnetic forces. In the depicted embodiment, once docked, structures of the binding base 125 may be engaged with structures of the board base 120 to hold the bases together, and, while engaged, the bases may be secured to one another in a configuration suitable for use. A locking mechanism may hold the bases in an engaged and secured configuration until manually released.

Figure 5:
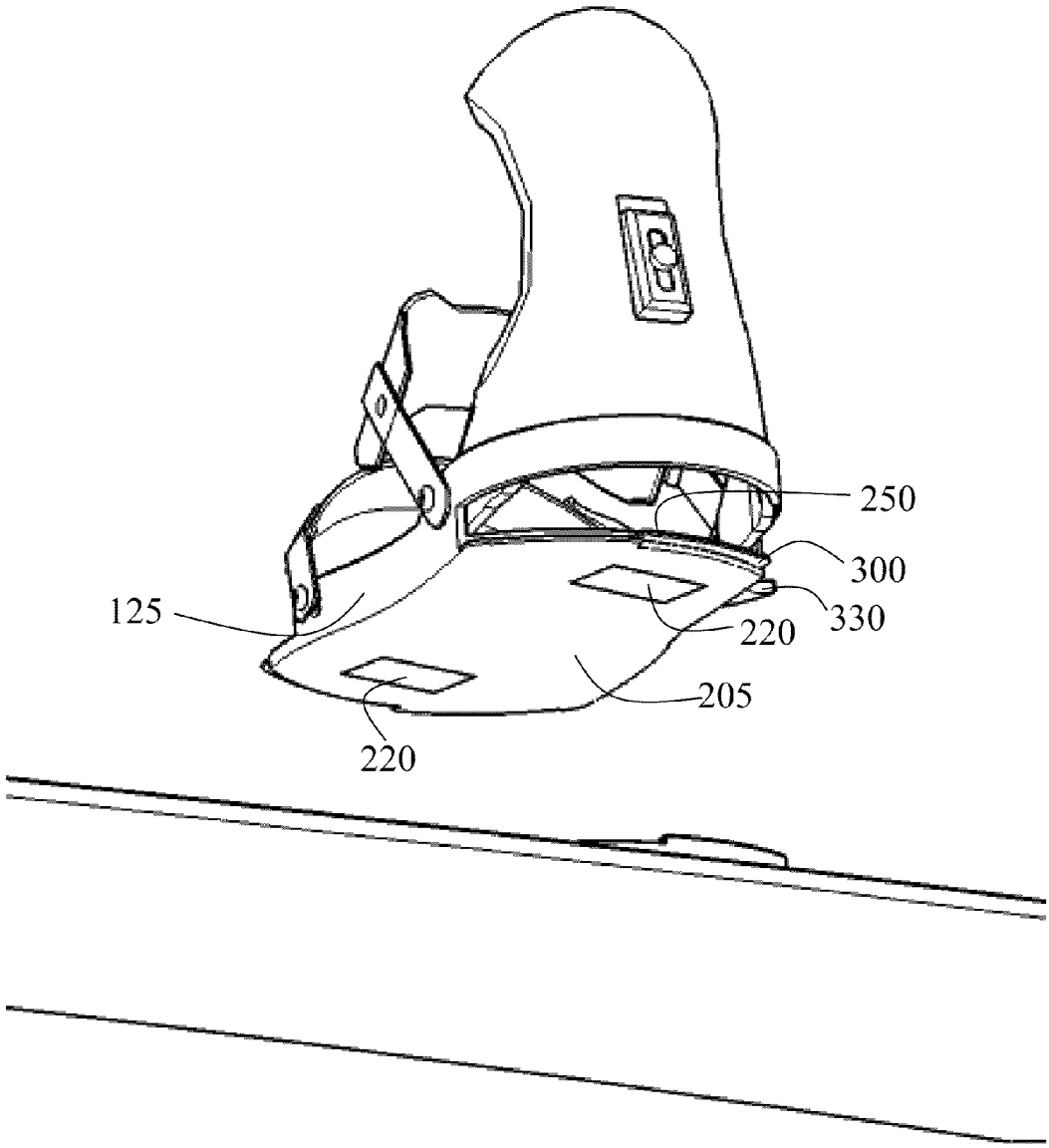
FIG. 5 depicts a binding base according to an embodiment of the invention.
Figure 6:
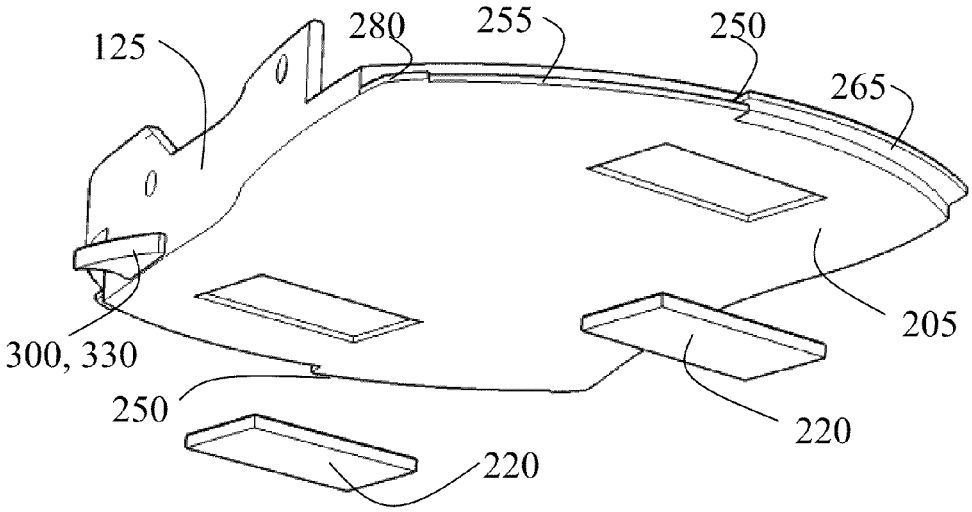
FIG. 6 is a partial exploded view of the underside of a binding base according to an embodiment of the invention.

As FIG. 5 and FIG. 6 depict, in an embodiment of the invention, the base 205 of the binding base 125 may contain one or more permanent magnets 220. One or more of the magnets 220 may be affixed to and/or embedded in the base 205, e.g., as one or more of the magnets 150 discussed previously may be affixed to and/or embedded in the board base 120. In an embodiment of the invention, one or more of the magnets 220 may be, e.g., partially covered by, or encased in, a material such as nickel or plastic to protect and/or to improve the durability of the magnet 220. Further, in an embodiment of the invention such as FIGS. 5 and 6 depict, no part of either magnet 220 protrudes from the lower surface of the base 205 of the binding base 125.

Figure 7:
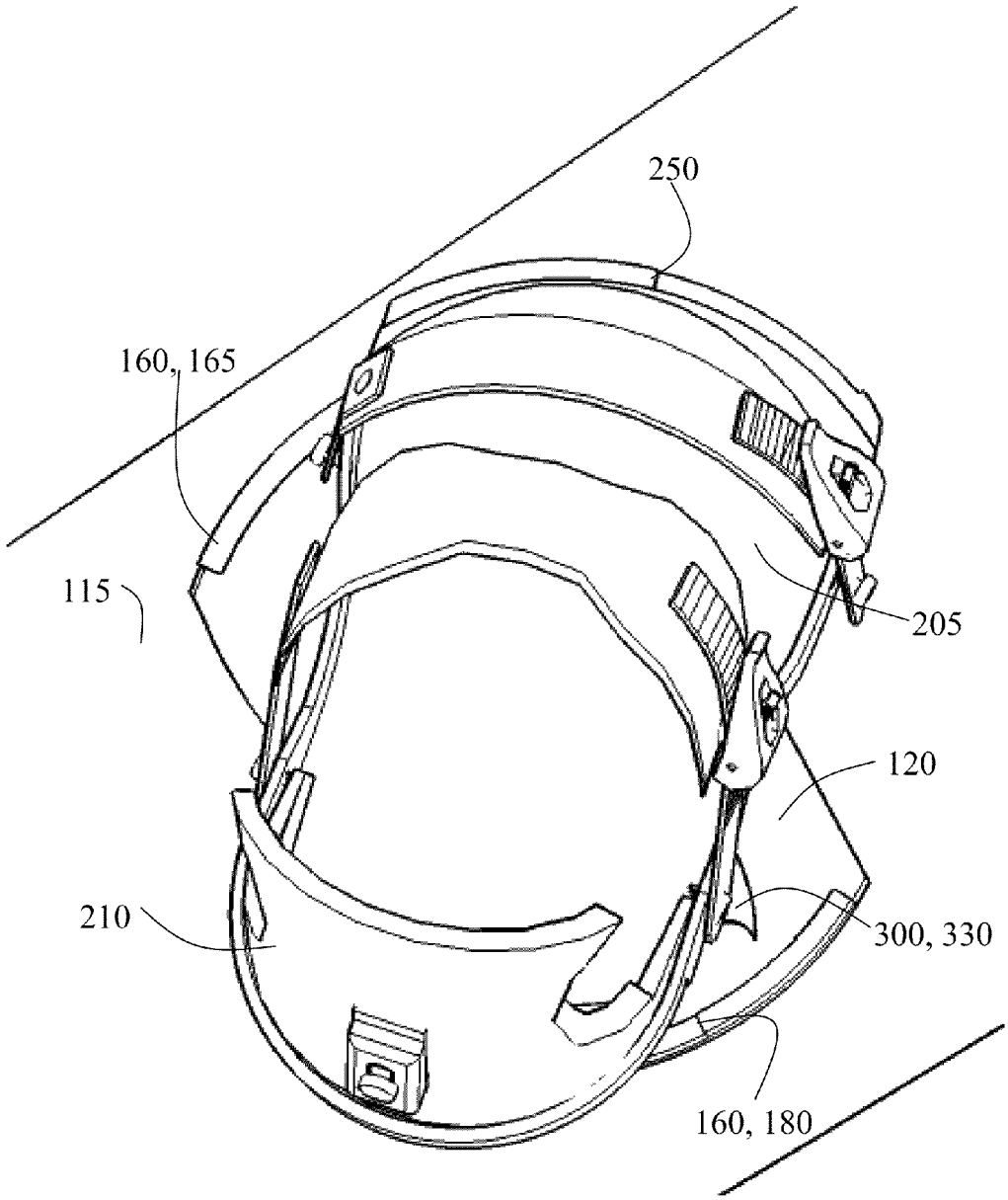
FIG. 7 is an overhead view of a binding base aligned with a board base for docking according to an embodiment of the invention.

In an embodiment of the invention such as FIGS. 5 and 6 depict, the relative polarities of the magnet 220 nearest to the toe end of the binding base 125 and the magnet 150 nearest to the toe end of the board base 120, as installed, may be such that the magnets 150, 220 attract one another, e.g., when the upright binding base 125 is placed vertically above the upper side of the board base 120, aligned, e.g., as FIG. 7 depicts. Similarly, in the depicted embodiment of the invention, the magnets 150, 220 nearest to the heel ends of the respective bases may be installed so that those magnets are also mutually attracted, e.g., when the bases are aligned as FIG. 7 depicts. The respective polarities may also be chosen such that the respective pairs of magnets 150, 220 are mutually repelled, e.g., if the binding base 125 is rotated 180 degrees relative to the board base 120 from the alignment that FIG. 7 depicts.

In an embodiment of the invention, the corresponding magnets 150 in the board base 120 and the magnets 220 in the binding base 125 may be substantially equal in size. In an embodiment of the invention, the corresponding magnets 150, 220 at each end of the respective bases 120, 125 may be vertically aligned relative to each other when the binding base 125 and the board base 120 are placed relative to one another, e.g., at an angle such as FIG. 7 depicts.

It will be appreciated that, in an embodiment of the invention such as FIGS. 1-7 depict, with magnets configured, e.g., as discussed above, magnetic attraction may hold the board base 120 to the binding base 125 in an alignment, e.g., as FIG. 7 depicts. The magnets 150, 220 may in an embodiment of the invention be chosen to be sufficiently strong such that the depicted alignment may be maintained, e.g., against gravity and/or incidental forces, until the user chooses to exert sufficient force to disturb that alignment. Suitable magnets are known in the art and may comprise, e.g., neodymium and/or other rare-earth magnets, but any sufficiently strong and compact magnets may be used in an embodiment of the invention.

In an embodiment of the invention, one or more magnets may be replaced, e.g., with a piece of ferromagnetic material (not pictured). In such an embodiment, each piece of ferromagnetic material in one base may correspond, e.g., to a magnet in the other base, e.g., such that magnetic attraction will pull the bases together into a docked configuration.

A binding base 125 in an embodiment of the invention may comprise lip features 250, e.g., corresponding to the shelf features 160 of the board base 120. In an embodiment of the invention, the lip features 250 describe, e.g., portions of an imaginary circle in a manner similar to that in which the shelves 160 of the board base 120 describe portions of an imaginary circle. The imaginary circle that the lip features 250 describe may in an embodiment of the invention have a slightly smaller diameter that that described by the shelves 160, which may, e.g., be consistent with the functions of the lip and shelf features described below.

In an embodiment of the invention, the placement and dimensions of the lip features 250 may be such that, for some relative placements of the board base 120 and the binding base 125, the lip features 250 and shelves 160 may be in an underlapping/overlapping configuration, e.g., such as FIGS. 8-14 depict. For example, in a configuration and/or alignment in which one or more of the lip features 250 are located wholly or partially underneath one or more of the shelves 160, e.g., as a result of rotation of the binding base 125 relative to the board base 120, the shelf may, e.g., prevent the binding base 125 from being simply pulled apart from the board base 125. In an embodiment of the invention, the orientation of the binding base 125 relative to the board base 120 must be changed, e.g., by rotation of the binding base 125 in the opposite direction, before the bases may be separated.

For example, in an embodiment of the invention such as one in which the shelves 160 on the board base 120 have the dimensions described above, the lip features of the binding base may be approximately 1/16 of an inch thick and offset in height by 1/16 of an inch. The lower lips 255, 260 may in such an embodiment of the invention be, e.g., flush with the bottom of the binding base. The upper lips, 265, 270 may in such an embodiment be located, e.g., 1/8 of an inch from the board base. The relative sizes and alignments of the shelves 160 and lip features 250 may in an embodiment of the invention be such that the lips 250 may slide relatively unimpeded below the respective corresponding shelves 160, e.g., as the binding base 125 is rotated relative to the board base 120, until a point of maximum rotation is achieved, e.g., as described below.

Notwithstanding the foregoing, in an embodiment of the invention, as the binding base 125 is rotated relative to the board base 120 towards a configuration in which the bases are secured together for use, the relative tightness of the engagement of the bases may increase, e.g., to prevent or reduce any wobbling or other unsteadiness in the joint. One or more of the shelves 160 and/or lips 250 may taper (not pictured) to increase this firmness, e.g., as the relative rotation increases. In such an embodiment, the required rotational force may increase as the degree of rotation increases, but the required force may not require, e.g., subjectively excessive exertion by the user.

Conversely, any such taper may, in an embodiment of the invention, be such that the relative tightness of the engagement of the bases is least at the point of initial engagement from, e.g., a docked configuration. Such a configuration may make it easier for a user to initially engage the bases by increasing the likelihood that the lips will engage properly with the shelves.

Figure 8:
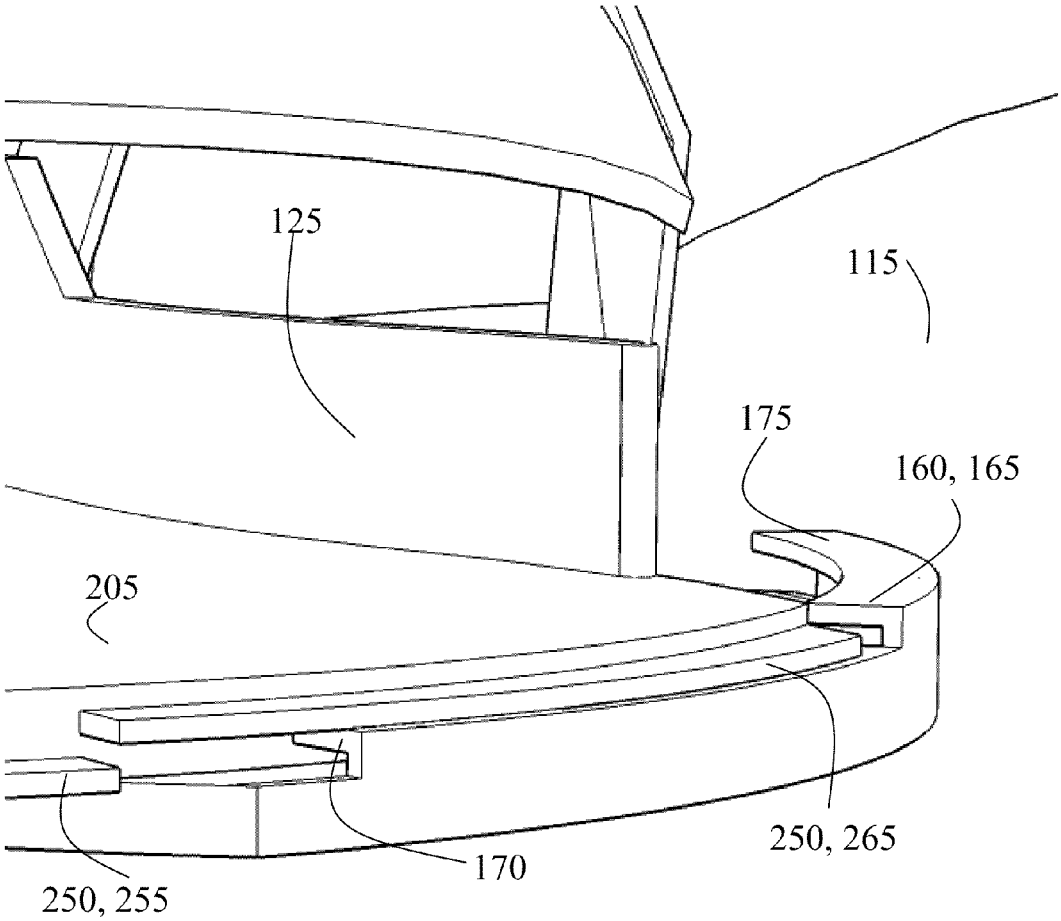
FIG. 8 is a view facing the toe end of a binding base docked with a board base according to an embodiment of the invention.
Figure 9:
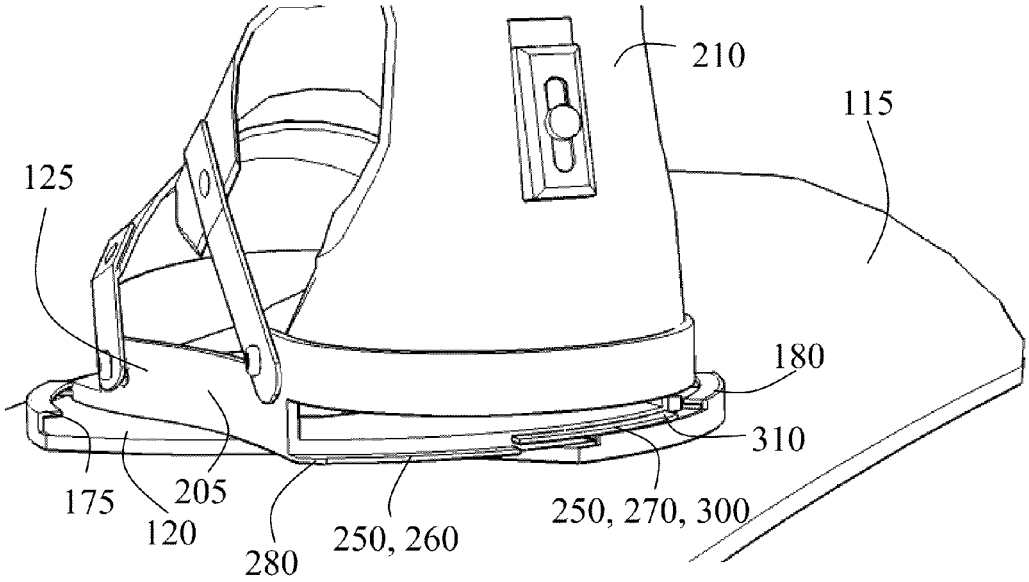
FIG. 9 is a view facing the heel end of a binding base docked with a board base according to an embodiment of the invention.
Figure 10:
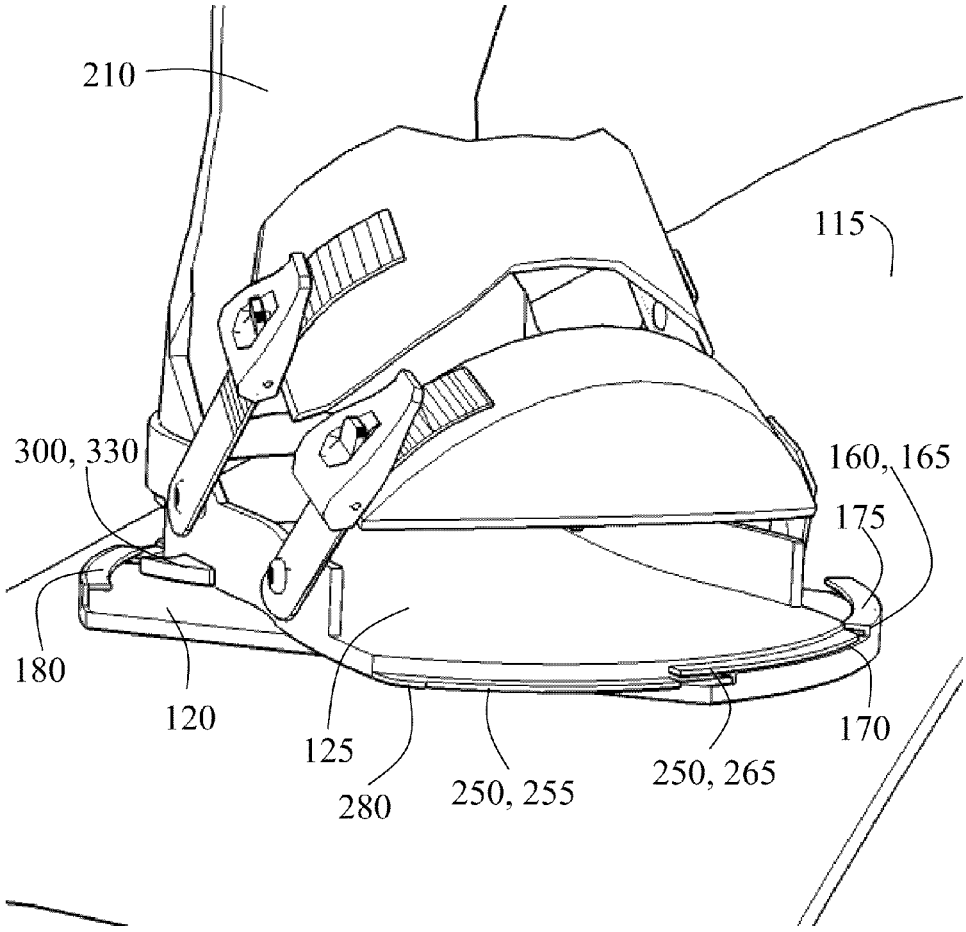
FIG. 10 is a view facing the toe end of a binding base docked with a board base according to an embodiment of the invention.
Figure 11:
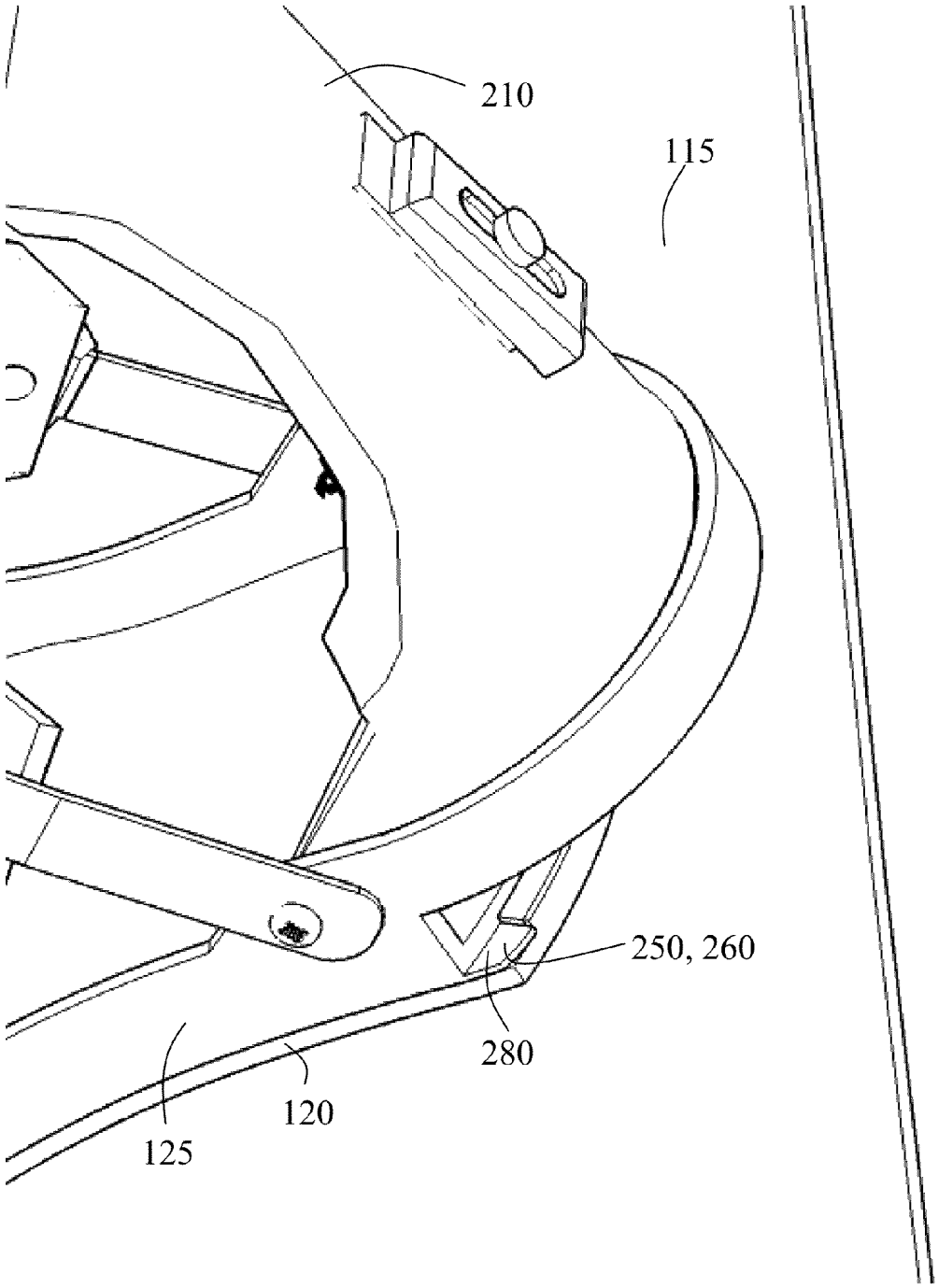
FIG. 11 depicts the heel ends of a binding base and a board base in a locked configuration according to an embodiment of the invention.
Figure 12:
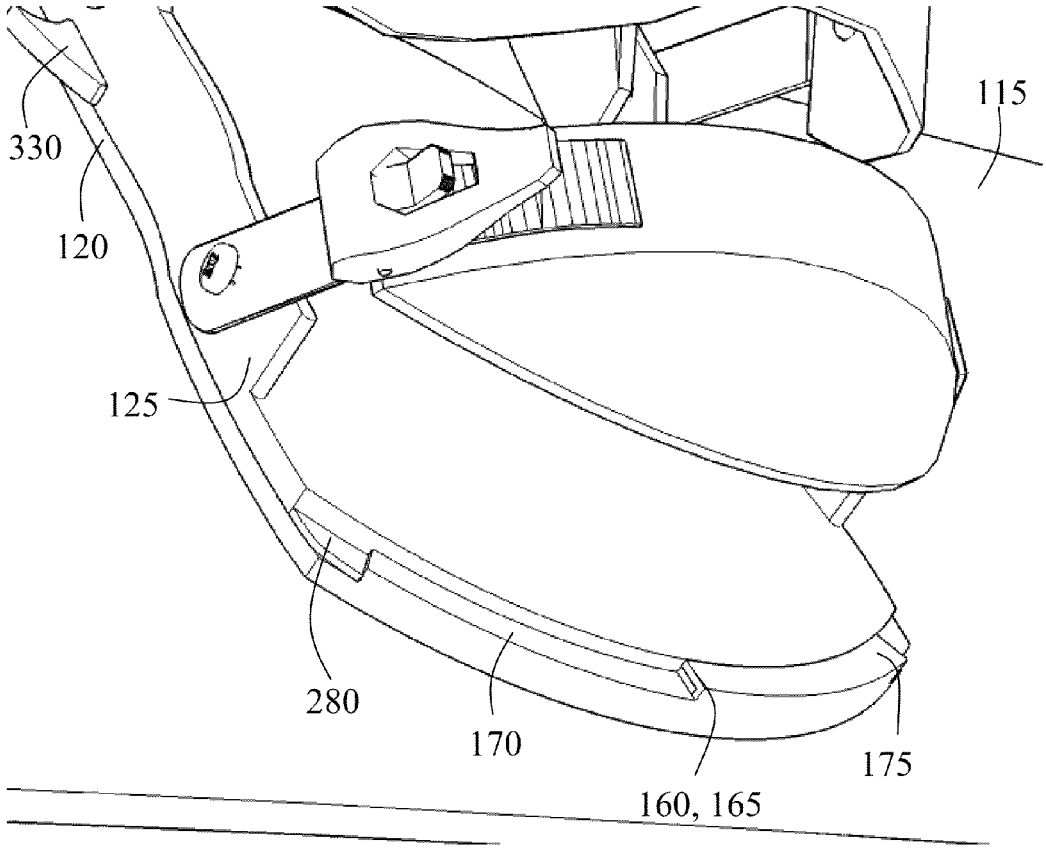
FIG. 12 depicts the toe ends of a binding base and a board base in a locked configuration according to an embodiment of the invention.
Figure 13:
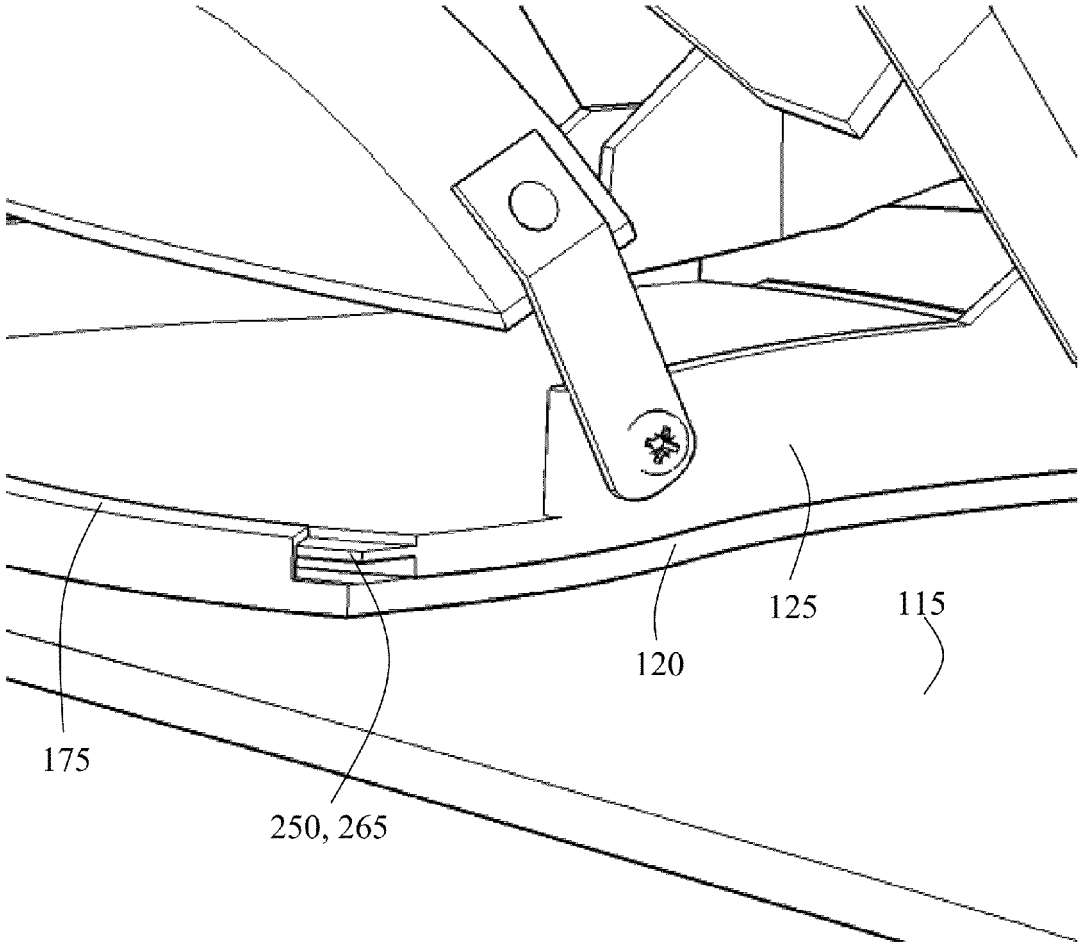
FIG. 13 depicts the toe ends of a binding base and a board base in a locked configuration according to an embodiment of the invention.

Returning to FIG. 7, as depicted, a board base 120 and a binding base 125 according to an embodiment of the invention are in what may be referred to as a docked configuration. In such a configuration, the corresponding meeting surfaces of the bases are sufficiently flush against one another to present no substantial impediments to rotating the bases relative to each other while maintaining substantial contact between the surfaces. As depicted, in this configuration, no overlap exists between any of the lip features 250 and any of the shelf features such as might interfere with the contact between the meeting surfaces of the bases. FIGS. 8-10 depict the relative positions of the lip features 250 and shelves 160 when the bases are in a docked configuration according to an embodiment of the invention.

It will be appreciated that in an embodiment of the invention such as depicted in the figures, the magnets may tend to hold the bases in a docked alignment such as FIG. 7 depicts. In an embodiment of the invention, geometry and/or one or more corresponding structures on one or both bases may serve to guide the bases into a docked configuration and/or to retain them in such a configuration, in addition to or instead of magnets as described above. It will be appreciated that in an embodiment of the invention in which rotation is used to engage structures that retain the bases in a joined configuration, any such structures may be designed not to interfere with such rotation: for example, a circular indentation (not pictured) in the underside of the binding base 125 may correspond to a circular raised portion (not pictured) on the upper side of the board base 120.

In the depicted embodiment of the invention, the corresponding lip structures 250 and shelves 160 engage to retain the binding after minimal counterclockwise rotation of the binding base 125 relative to the board base 120. In an embodiment of the invention, maximal counterclockwise rotation may be achieved when the lateral edges of the bases are evenly aligned with one another. For example, in the depicted embodiment of the invention, beginning from the docked configuration, the binding base 125 may rotate counterclockwise through an angle of 45 degrees, at which point a locking mechanism engages. FIGS. 11-14 depict the bases in such a configuration according to an embodiment of the invention. In the depicted embodiment, one or more of the lips 250 may incorporate a projection 280 that may be placed to encounter the edge of one or more of the corresponding shelves 160, e.g., to impede rotation beyond the point of maximum relative rotation.

It will be appreciated that the depiction in FIGS. 11-14 is illustrative and not limiting. In an embodiment of the invention, the direction of rotation may be clockwise instead of counterclockwise. In an embodiment of the invention, the angle of relative rotation traversed from the docked configuration to the locked configuration may be greater or lesser than 45 degrees.

At this point of relative rotation, in an embodiment of the invention, a locking mechanism may secure the bases in their relative positions, e.g., making the snowboard and binding ready for riding. In an embodiment of the invention, a locking mechanism comprises a sliding, spring-loaded latch. The latch may engage, e.g., when the binding base has engaged with the board base and been rotated counterclockwise until the edges of the bases are flush with one another, and the latch may thereby maintain the relative positions of the bases, e.g., while the user is riding the snowboard. In an embodiment of the invention, the user may manually disengage the latch, e.g., by sliding or otherwise moving one or more components, thereby allowing, e.g., clockwise rotation of the binding base relative to the board base, returning the bases to a docked configuration, in which the bases may be disengaged.

Figure 14:
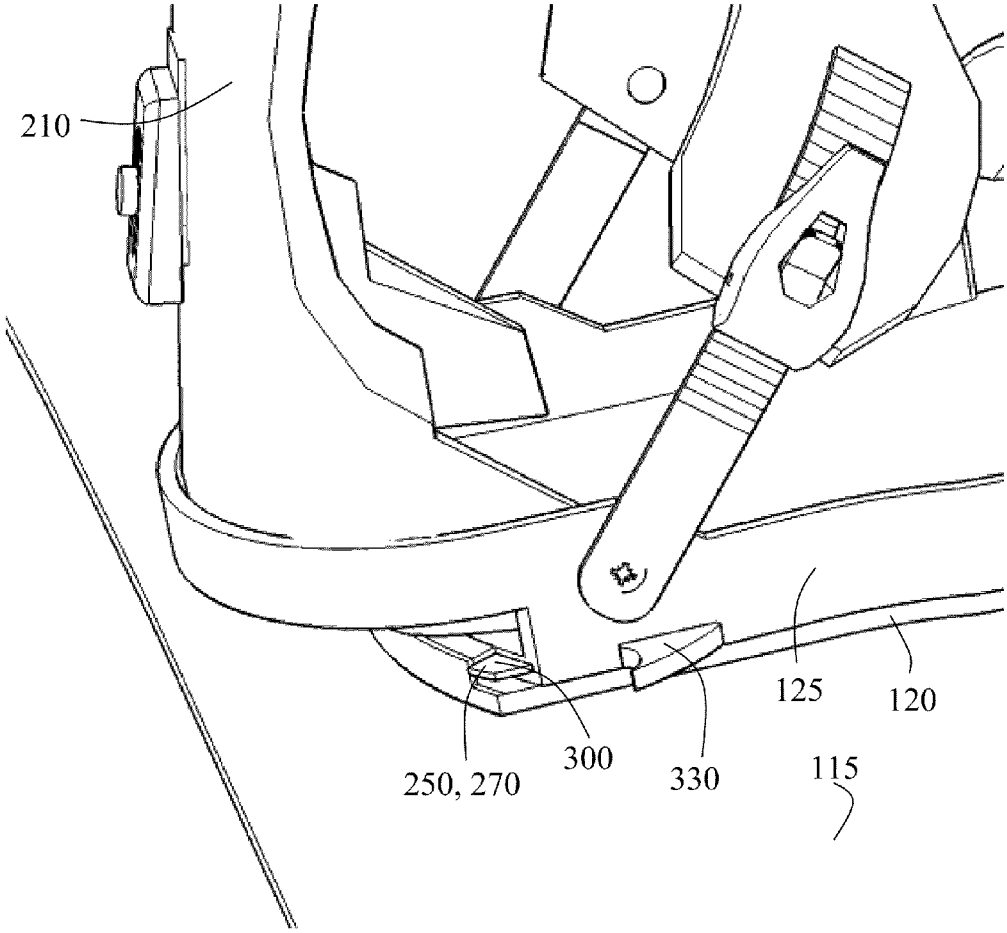
FIG. 14 depicts the heel ends of a binding base and a board base in a locked configuration according to an embodiment of the invention.
Figure 15:
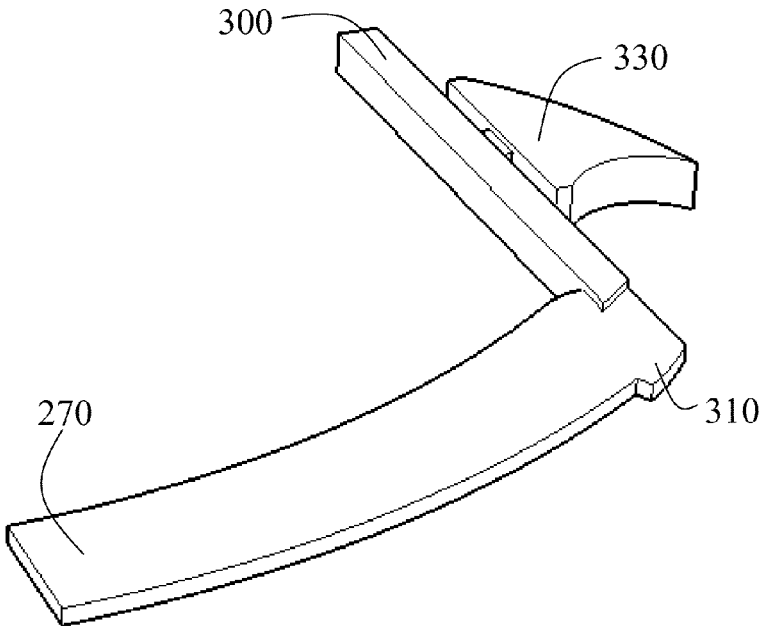
FIG. 15 depicts a latch according to an embodiment of the invention.
Figure 16:
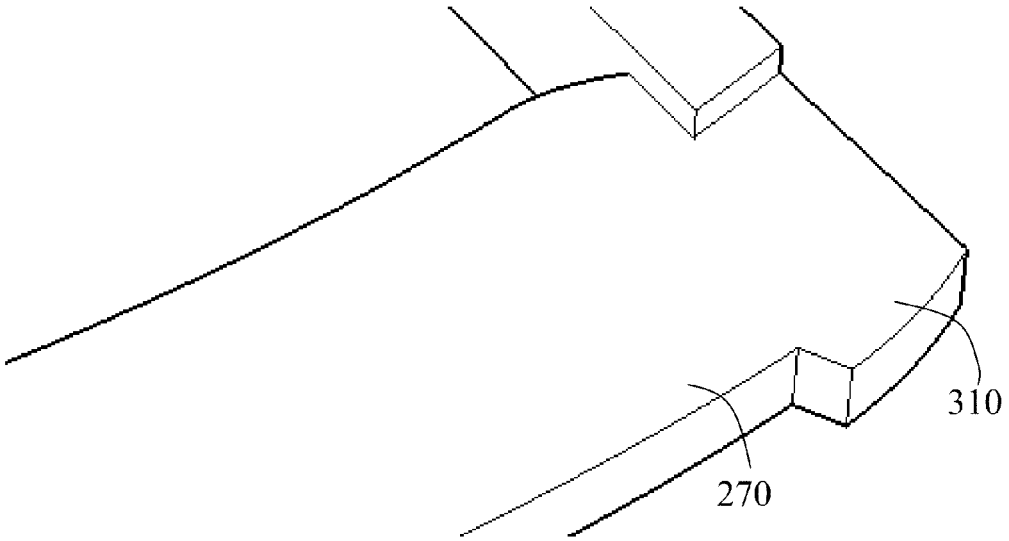
FIG. 16 depicts a projection from a lip feature that may be incorporated into a latch according to an embodiment of the invention.

FIGS. 15-22 depict a locking mechanism, including a latch as described above, according to an embodiment of the invention. FIG. 15 depicts a sliding latch 300, according to an embodiment of the invention, which incorporates a heel-side lip 270. In the depicted embodiment of the invention, the lip 270 incorporates a projection 310 shaped to push the latch 300 into the binding base 125 while the bases are engaged. As depicted, the shape of the projection 310, combined with the corresponding shape of a shelf 180 (FIG. 2) of the board base 120 (FIG. 2) also allows the latch 300 to extend from the binding base 125 when the bases are rotated to the locking position. By extending when the bases are in, e.g., a relative alignment such as FIG. 14 depicts, in an embodiment of the invention, the projection may hold the bases in this relative position.

Figure 17:
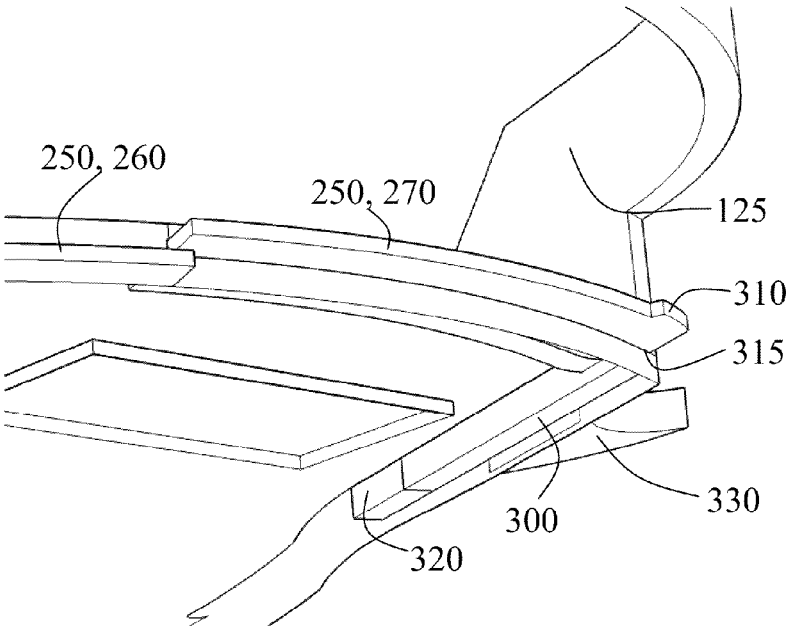
FIG. 17 depicts a latch assembled into a binding base according to an embodiment of the invention.

FIG. 17 depicts the latch 300 assembled into the binding base 125 according to an embodiment of the invention. (In FIGS. 17 and 18, the bottom of the binding base 125 has been cut away to reveal features of the binding base 125.) In such an embodiment, the heel-side lip 270 incorporated into the latch 300 may extend outwards from the heel side of the binding base 125 through a slot 315 in the binding base 125. In an embodiment of the invention, the dimensions of the slot 315 may be, e.g., slightly larger than those of the lip 270, chosen to allow the latch 300 to slide freely in the slot 315 yet minimize vertical and horizontal play of the latch 300 in the slot 315 while in use.

The position of the slot 315 in the binding base 125 may be chosen, e.g., so that the lip 270 engages with the corresponding shelf 180 (FIG. 2) on the board base 120 when the bases are docked and then rotated.

Figure 18:
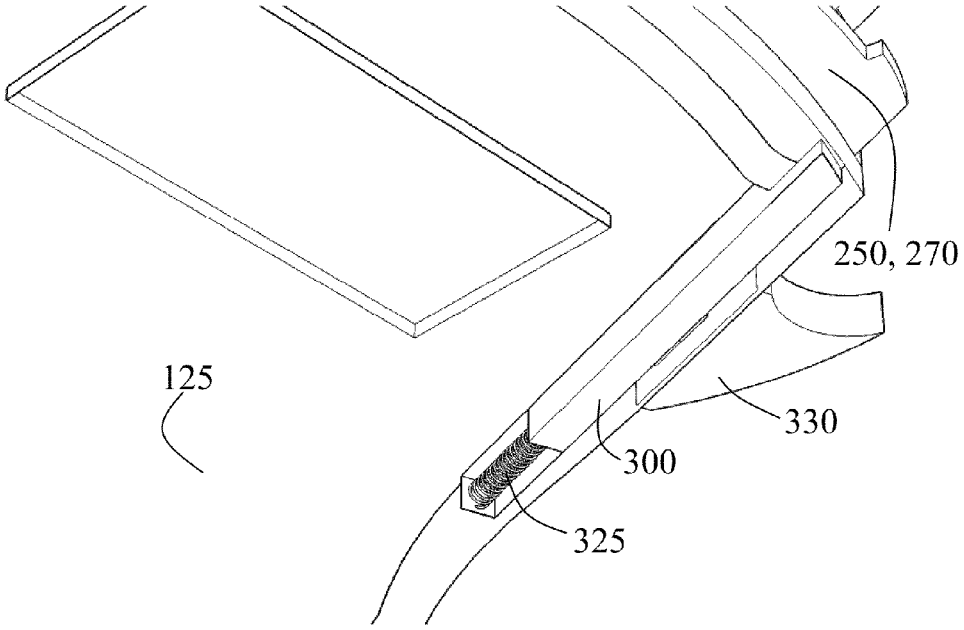
FIG. 18 is a cutaway view of binding base including a spring-loaded latch according to an embodiment of the invention.

As FIG. 17 depicts, the binding base 125 in an embodiment of the invention includes a receptacle 320 or guide configured to receive the end of the latch 300 opposite to the lip 270. In the depicted embodiment of the invention, a spring 325 may be held in the receptacle 320 such that, when the latch 300 is pushed into the binding base 125, the spring 325 exerts a force tending to push the latch back out. FIG. 18 depicts the binding base 125 with the receptacle 320 cut away to illustrate the relative placement of the latch 300, the spring 325, and the binding base 125 according to an embodiment of the invention.

In an embodiment of the invention, the configuration of the latch 300, receptacle 320, and binding base 125 may be such that at least a portion of the latch 300 remains within the receptacle 320 regardless of the degree to which the latch 300 has been pushed into the binding base 125 or extends outward from it, e.g., to help maintain the relative alignment of the latch 300 and the binding base.

Figure 19:
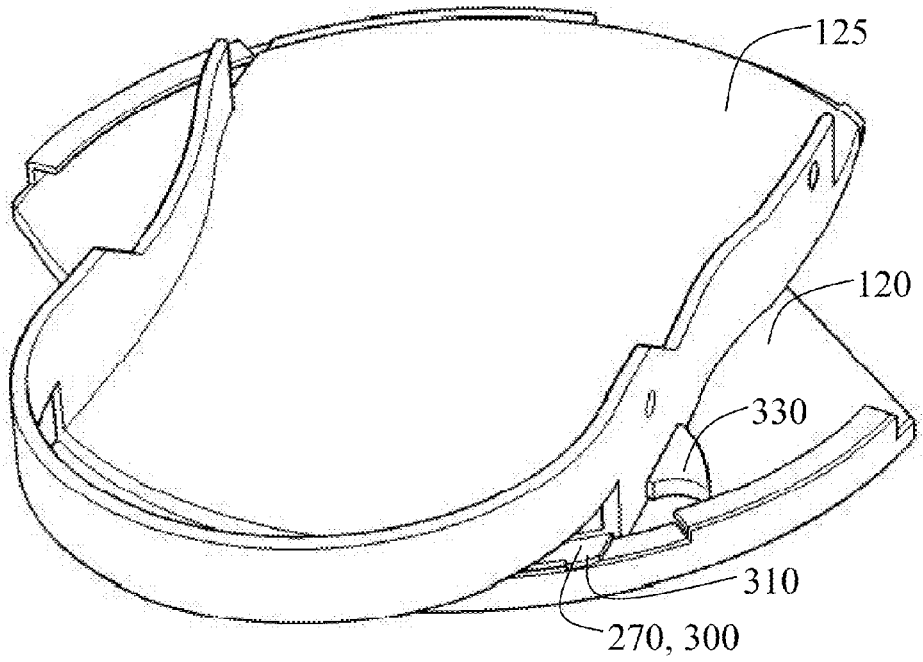
FIGS. 19-22 depict a latch through relative rotation of a board base that is engaged with a binding base according to an embodiment of the invention.

FIGS. 19-22 illustrate the relative position and interaction of the latch 300, the binding base 125, and the board base 120 as the bases are docked, engaged, and locked according to an exemplary embodiment of the invention. In FIG. 19, the bases have been docked, e.g., as described above, but have not been engaged, e.g., by rotation of the binding base 125 relative to the board base 120.

Figure 20:
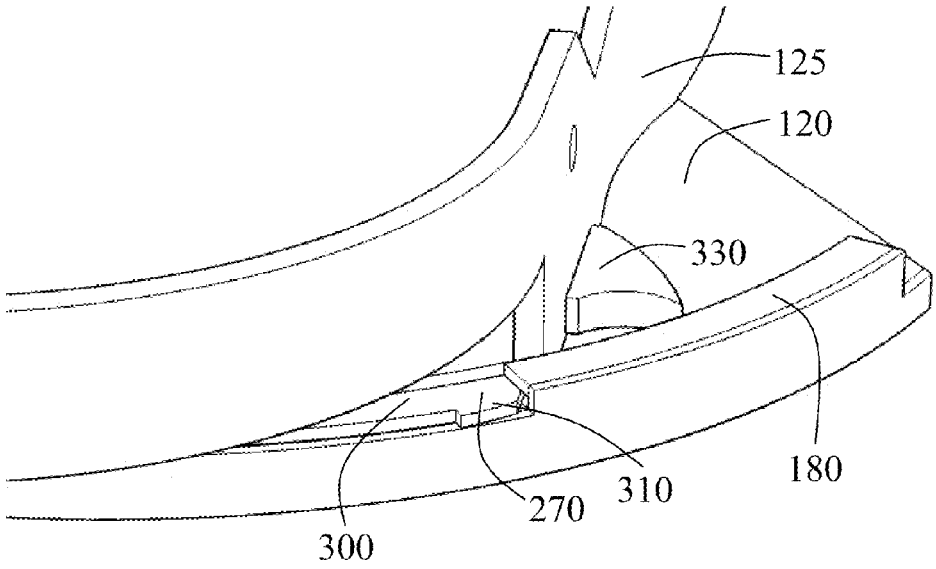

As depicted in FIG. 20, the bases have been rotated from the docked position so that the lip 270 has begun to engage the shelf 180. According to an embodiment of the invention, one or more other lips may engage the respective corresponding shelves at a greater or smaller angle of relative rotation than that at which the lip 270 incorporated into the latch 300 begins to engage. As depicted in FIG. 20, the shape of the projection 310 from the lip 270 is such as to exert a force radially inward on the lip 270 as the degree of relative rotation increases, pushing the latch 300 into the binding base 125.

Figure 21:
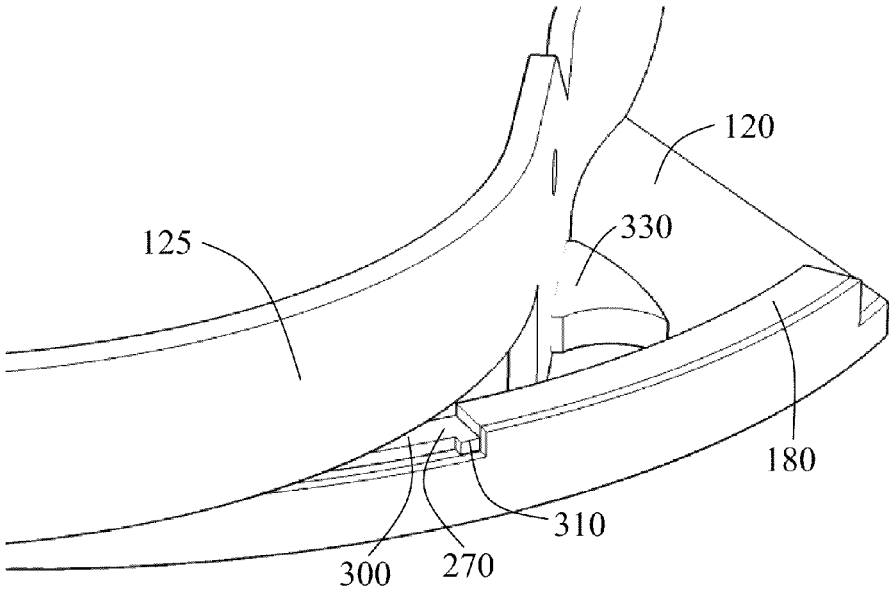

FIG. 21 depicts the binding base 125 and the board base 120 at a slightly greater angle of rotation than that depicted in FIG. 20, according to an embodiment of the invention. In an embodiment such as is depicted, the shape of the projection 310 may be such that further rotation of the binding base 125 relative to the board base 120 will not push the latch 300 substantially further into the binding base.

Figure 22:
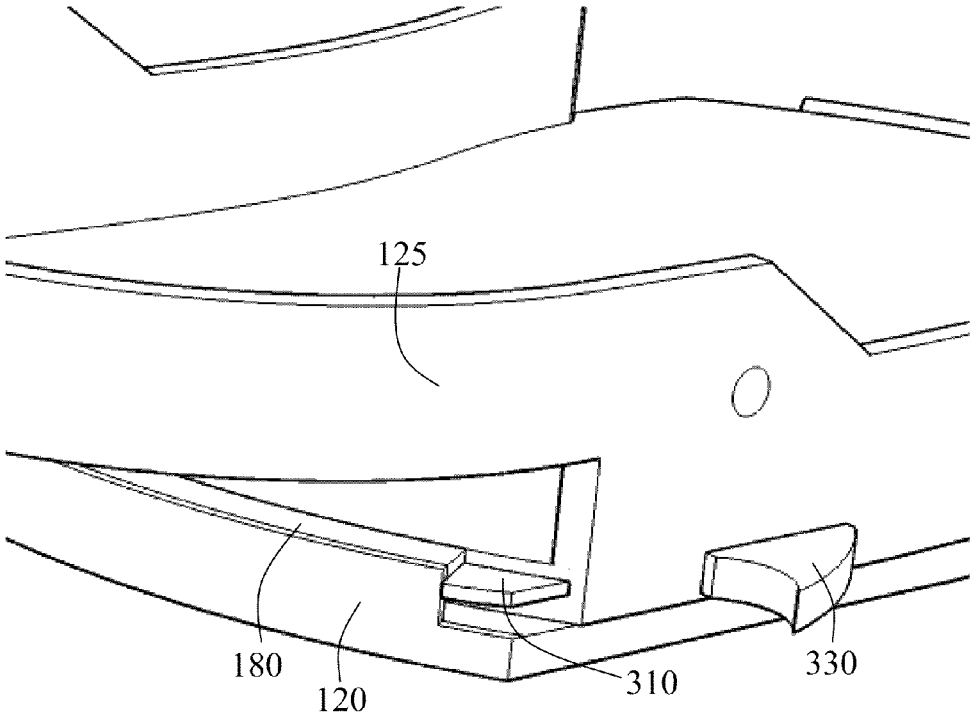

FIG. 22 depicts the binding base 125 and the board base 120 at maximal relative rotation, in a locked configuration, e.g., suitable for use according to an embodiment of the invention. In an embodiment of the invention such as FIG. 22 depicts, the shelf 180 may not extend to the outward lateral edge of the binding base 125. So configured, when maximal relative rotation is achieved, the projection 310 may be freed from the inward radial force and may consequently be pushed outward by the spring 325 (not pictured). In the depicted embodiment of the invention, the inner edge of the projection 310 may rest against the outer edge, e.g., of the shelf 180 or its vertical support, thereby impeding clockwise rotation of the binding base 125 relative to the board base 120.

In an embodiment of the invention such as FIG. 22 depicts, the latch 300 may comprise, e.g., a slider 330, which may be used to push the latch 300 back into the binding base 125, disengaging the locking mechanism and allowing the clockwise rotation of the binding base 125 relative to the board base 120. Such rotation may, in an embodiment of the invention, return the bases, e.g., to a docked position, allowing the user to separate them.

Figure 23:
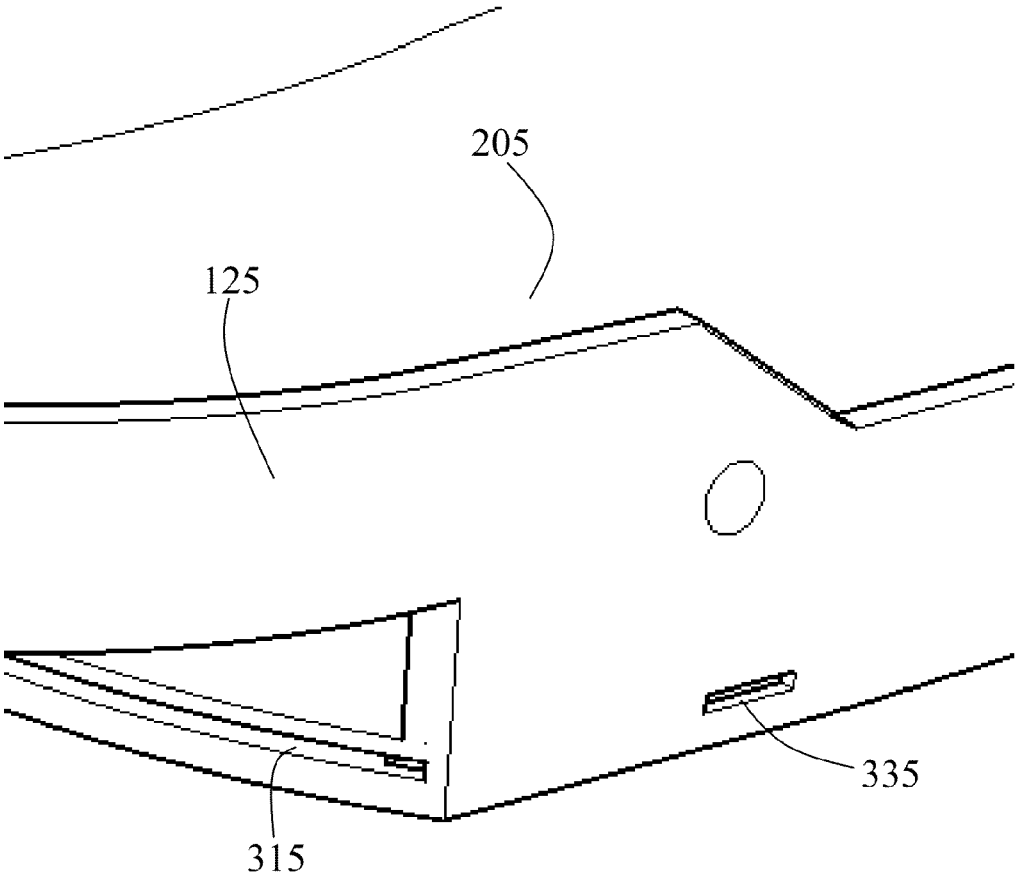
FIG. 23 depicts a base of a binding base according to an embodiment of the invention.

In an embodiment of the invention, a portion of the latch 300 may extend, e.g., through a slot 335 (FIG. 22) in the outer side of the binding base 125, and the slider 330 may be attached to the latch 300, e.g., during assembly. Such a configuration, according to an embodiment of the invention, may also, e.g., further stabilize the relative alignment of the latch 300 relative to the binding base 125. FIG. 23 depicts a base 205 of a binding base 125 that incorporates a slot 315 for the lip 270 of a shelf and a slot 335 for passing part of the latch 300 through, to a slider 335, according to an embodiment of the invention.

It will be appreciated that an embodiment of the invention and/or any one or more components thereof may be made of any one or more suitable materials separately or in combination. For example, suitable materials for the board base 120, binding base 125, and/or latch 300 in an embodiment of the invention may include, e.g., plastic (including but not limited to polycarbonate and/or other thermoplastics), nylon, glass injected plastic, carbon fiber, and aluminum and other lightweight, durable metals, among many other possibilities.

The dimensions of the components of an embodiment of the invention may reflect the intended use of the embodiment, including, for example, considerations such as the expected sizes of the snowboard deck 115 to which the board base 120 may be secured and the boot (and, by extension, the user's foot) that may be secured within the binding base 125. In one exemplary embodiment of the invention, the board base 120 may be roughly 6 inches wide (meaning left to right in relation to the user's foot and boot), approximately 9 inches long (meaning toes to heel in relation to the user's foot and boot), and approximately 3/16 inch thick. In an embodiment of the invention, the board base 120 will match the outline dimensions of the binding base 125 to create a flush fit when the entire system is locked and operable. It will be appreciated that these dimensions may be departed from significantly, with or without maintaining any or all proportions, without affecting the operating principle of embodiments of the invention.

It will be appreciated that an embodiment of the invention configured such that a user may dock, engage, and lock the bases as described herein in connection with embodiments of the invention may permit a user to easily secure the user's foot to a snowboard for use without use of the hands. For example, a user may be seated, e.g., on a ski lift, with one foot secured to a snowboard, e.g., by a conventional binding or by a binding according to an embodiment of the invention. The user's other foot may be wearing a boot that is secured within a binding base 125 according to an embodiment of the invention, and the binding base 125 may correspond to a board base 120 that is permanently secured to the snowboard deck 115.

In such circumstances, according to an embodiment of the invention, the user may dock the board base 120 with the binding base 125, e.g., by moving a foot so that the bottom of the foot (and thus the bottom of the binding base 125) is within a few inches of the top of the board base 120, canted approximately 45 degrees counterclockwise to the board base. So aligned, in accordance with an embodiment of the invention, magnetic attraction may, e.g., draw the board base 120 and the binding base 125 into a docked configuration.

Having docked the board base 120 and binding base 125, the user may then rotate the boot and the enclosing binding base 125 45 degrees counterclockwise to a point of maximum relative rotation, e.g., as described above, at which the edges of the bases are flush with one another. The latch 300 may then engage, holding the bases in such a relative alignment until released by the user.

The relative placement and sizes of the lips and shelves may in an embodiment of the invention hold the bases firmly together. While locked in such a position, the effect of the joined bases may, in an embodiment of the invention, be considered equivalent to creating a solid 7/16 inch base.

The invention claimed is:

1. A binding, comprising:

a binding base;

the binding base configured to dock to at least a portion of a board, wherein the portion of the board includes a board base;

the binding base, when docked to the portion of the board, further configured to rotate in a first direction to secure the binding base to the portion of the board;

the binding base, when secured to the portion of the board, further configured to rotate in a second direction to allow separation of the binding base from the portion of the board; and one or more magnets configured to couple to at least one of the binding base and the portion of the board, wherein the one or more magnets are further configured to dock the binding base with the portion of the board before the binding base rotates in the first direction, wherein at least one of the magnets, when docked, is aligned with a second magnet, and wherein the at least one of the magnets is not aligned with the second magnet after the binding base rotates in the first direction.

2. The binding of claim 1, further comprising a lock configured to prevent the binding base from rotating in the second direction.

3. The binding of claim 1, wherein at least one of the first direction and the second direction is at least one of a clockwise and a counter clockwise rotation of the binding base around an axis perpendicular to the board.

4. The binding of claim 1, wherein the first direction includes a counter clockwise rotation of the binding base around an axis perpendicular to the board.

5. The binding of claim 2, wherein the lock is configured to mechanically engage the binding base when the binding base rotates in the first direction.

6. The binding of claim 1, wherein at least one of the portion of the board and the binding base includes one or more shelves, wherein at least one of the portion of the board and the binding base includes one or more lips, and wherein the one or more shelves are located in relation to the one or more lips to prevent separation of the binding base from the portion of the board when the binding base rotates in the first direction.

7. The binding of claim 1, wherein the binding base, when initially docked to the portion of the board, is not aligned with the portion of the board.

8. A board binding apparatus, comprising:

a binding base;

a board base configured to affix to a board deck;

the binding base configured to dock with the board base;

the binding base, when docked to the board base, further configured to rotate in a first direction relative to the board base to prevent undocking of the binding base from the board base;

the binding base, after rotating in the first direction, further configured to rotate in a second direction relative to the board base to allow undocking of the binding base from the board base, and one or more magnets configured to couple to at least one of the binding base and the board base, wherein the one or more magnets are further configured to dock the binding base with the board base before the binding base rotates in the first direction, wherein at least one of the magnets, when docked, is aligned with a second magnet, and wherein the at least one of the magnets is not aligned with the second magnet after the binding base rotates in the first direction.

9. The board binding apparatus of claim 8, further comprising a lock configured to prevent the binding base from rotating in the second direction.

10. The board binding apparatus of claim 8, wherein at least one of the first direction and the second direction is at least one of a clockwise and a counter clockwise rotation relative to the board base.

11. The board binding apparatus of claim 8, wherein the first direction includes a counter clockwise rotation of the binding base relative to the board base.

12. The board binding apparatus of claim 9, wherein the lock is configured to mechanically engage the binding base when the binding base rotates in the first direction.

13. The board binding apparatus of claim 8, wherein at least one of the board base and the binding base includes one or more shelves, and wherein at least one of the board base and the binding base includes one or more lips and wherein the one or more shelves are located in relation to the one or more lips to prevent undocking of the binding base from the board base when the binding base rotates in the first direction.

14. The board binding apparatus of claim 8, wherein the binding base, when initially docked to the board base, is not aligned with the board base.

15. A binding apparatus, comprising:

a binding base configured to dock to a board base, the board base configured to affix to a board deck;

the binding base, when docked to the board base, further configured to rotate in a first direction around an axis perpendicular to the board base to prevent undocking of the binding base from the board base;

the binding base, after rotating in the first direction, further configured to rotate in a second direction around the axis perpendicular to the board base to allow undocking of the binding base from the board base; and one or more magnets configured to couple to at least one of the binding base and the board base, wherein the one or more magnets are further configured to dock the binding base to the board base before the binding base rotates in the first direction, wherein at least one of the magnets, when docked, is aligned with a second magnet, and wherein the at least one of the magnets is not aligned with the second magnet after the binding base rotates in the first direction.

16. The binding apparatus of claim 15, further comprising a lock configured to prevent the binding base from rotating in the second direction.

17. The binding apparatus of claim 15, wherein at least one of the first direction and the second direction is at least one of a clockwise and a counter clockwise rotation around the axis perpendicular to the board base.

18. The binding apparatus of claim 15, wherein at least one of the board base and the binding base includes one or more shelves, and wherein at least one of the board base and the binding base includes one or more lips, and wherein the one or more shelves are located in relation to the one or more lips to prevent undocking of the binding base from the board base when the binding base rotates in the first direction around the axis perpendicular to the board base.

19. The binding apparatus of claim 15, wherein the binding base, when initially docked to the board base, is not aligned with the board base.

20. The binding apparatus of claim 16, wherein the lock is configured to mechanically engage the binding base when the binding base rotates in the first direction around the axis perpendicular to the board base.

* * * * *